US009086253B2

(12) United States Patent
Oh et al.

(10) Patent No.: US 9,086,253 B2
(45) Date of Patent: Jul. 21, 2015

(54) POWERED RAIL SYSTEM FOR A WEAPON

(75) Inventors: Lawrence Se-Jun Oh, Hummelstown, PA (US); Robert Neil Mulfinger, York Haven, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 20 days.

(21) Appl. No.: 13/599,313

(22) Filed: Aug. 30, 2012

(65) Prior Publication Data

US 2014/0059911 A1 Mar. 6, 2014

(51) Int. Cl.

| | |
|---|---|
| ***F41C 27/00*** | (2006.01) |
| ***F41C 23/22*** | (2006.01) |
| ***F41G 11/00*** | (2006.01) |
| ***F41C 23/16*** | (2006.01) |

(52) U.S. Cl.

CPC ..... *F41C 23/22* (2013.01); *F41C 23/16* (2013.01); *F41C 27/00* (2013.01); *F41G 11/003* (2013.01)

(58) Field of Classification Search

CPC ..... F41C 27/00; F41C 23/16; F41C 23/22; F41A 35/00; F41A 21/00; F41A 21/44; F41A 13/12; F41G 11/001; F41G 11/003; F41G 1/387

USPC ..... 42/84, 71.01, 90

See application file for complete search history.

(56) References Cited

U.S. PATENT DOCUMENTS

| | | | | |
|---|---|---|---|---|
| 2,134,406 | A * | 10/1938 | Jacobs | 42/1.01 |
| 4,007,553 | A * | 2/1977 | Clegg | 42/1.01 |
| 4,134,223 | A * | 1/1979 | Hillenbrandt et al. | 42/84 |
| 7,627,975 | B1 * | 12/2009 | Hines | 42/84 |
| 7,669,359 | B2 | 3/2010 | Kim | |
| 7,676,975 | B2 * | 3/2010 | Phillips et al. | 42/72 |
| 7,802,392 | B2 * | 9/2010 | Peterson et al. | 42/75.03 |
| 7,975,419 | B2 | 7/2011 | Darian | |
| 8,006,428 | B2 | 8/2011 | Moore et al. | |
| 8,028,460 | B2 * | 10/2011 | Williams | 42/90 |
| 8,091,265 | B1 | 1/2012 | Teetzel et al. | |
| 8,091,267 | B2 | 1/2012 | Moore et al. | |
| 8,104,211 | B2 | 1/2012 | Darian | |
| 8,151,505 | B2 * | 4/2012 | Thompson | 42/84 |
| 8,590,201 | B2 * | 11/2013 | Brixius | 42/71.01 |
| 8,656,622 | B2 * | 2/2014 | Peterson et al. | 42/75.03 |
| 2003/0077937 | A1 * | 4/2003 | Berg et al. | 439/500 |
| 2008/0134562 | A1 * | 6/2008 | Teetzel | 42/146 |
| 2009/0288324 | A1 * | 11/2009 | Peterson et al. | 42/75.03 |

(Continued)

FOREIGN PATENT DOCUMENTS

| | | |
|---|---|---|
| WO | WO2011/085295 | 7/2011 |
| WO | WO2011/085464 | 7/2011 |

OTHER PUBLICATIONS http://tworxventures.com/images/pdfs/110527_tpr_brochure_web.pdf, with more information http://tworxventures.com/technology.

*Primary Examiner* — Joshua Freeman

(57) ABSTRACT

A powered rail system is provided for a weapon that includes a barrel. The powered rail system includes a base having a longitudinal opening. The base is configured to be mounted to the weapon such that the barrel is received within the longitudinal opening and the base extends around at least a segment of a length of the barrel. A rail extends from the base. An electrical component is mounted to the rail. An electrical power source is held by the base. The electrical power source is electrically connected to the electrical component for supplying the electrical component with electrical power.

19 Claims, 6 Drawing Sheets

(56) References Cited

U.S. PATENT DOCUMENTS

| | | | | |
|---|---|---|---|---|
| 2010/0031552 | A1* | 2/2010 | Houde-Walter | 42/72 |
| 2010/0083553 | A1* | 4/2010 | Montgomery | 42/84 |
| 2010/0192446 | A1* | 8/2010 | Darian | 42/84 |
| 2010/0275489 | A1 | 11/2010 | Cabahug et al. | |
| 2011/0010979 | A1* | 1/2011 | Houde-Walter | 42/84 |
| 2011/0061284 | A1 | 3/2011 | Cabahug et al. | |
| 2011/0100204 | A1* | 5/2011 | Schlenkert et al. | 89/14.1 |
| 2011/0154712 | A1 | 6/2011 | Moore et al. | |
| 2011/0157388 | A1 | 6/2011 | Liu | |
| 2012/0079752 | A1* | 4/2012 | Peterson et al. | 42/75.02 |
| 2012/0167435 | A1* | 7/2012 | Poling | 42/90 |
| 2013/0036646 | A1* | 2/2013 | Rubac et al. | 42/90 |
| 2013/0061503 | A1* | 3/2013 | W. et al. | 42/76.01 |
| 2014/0082990 | A1* | 3/2014 | Lee | 42/96 |

* cited by examiner

POWERED RAIL SYSTEM FOR A WEAPON

BACKGROUND OF THE INVENTION

The subject matter herein relates generally to weapons, and more particularly, to a powered rail system for a weapon.

Some known weapons (e.g., AR-15s, M4's, M-16's, other firearms, etc.) include a rail system that extends around the barrel of the weapon. The rail system includes one or more accessory rails that enable accessories to be mounted to the weapon. For example, such accessories may include lasers, lights, sights, range finders, night vision scopes, telescopic scopes, cameras, microphones, and/or speakers.

Some accessories that are mounted to the rail system are electrical accessories that require a supply of electrical power to operate. But, the electrical power supplies of at least some known weapons are positioned at a location along the length of the weapon that is remote from the corresponding electrical accessories. For example, the rail system and the electrical accessories mounted thereto may be located in front of or above the chamber of the weapon, while the corresponding electrical power source is located behind and/or below the chamber in a butt stock or grip of the weapon.

A reliable electrical connection between the electrical accessories and the remote electrical power supply has heretofore proven difficult to obtain. Some known weapons route electrical power from the electrical power source to the remote electrical accessories using electrical wires and/or electrical connectors that extend along the outside of the weapon. But, such external electrical wires and connectors may tend to catch or snag on other objects, which may hinder use of the weapon and/or damage the electrical wires and/or connectors. Moreover, snagging of the external electrical wires and/or connectors may inadvertently disengage mated electrical connectors and thereby sever the electrical connection between the electrical accessories and the remote electrical power source. External electrical wires and connectors may also be susceptible to damage from ambient conditions and/or may present sealing difficulties that reduce the reliability of the electrical connection between the electrical accessories and the remote electrical power source.

Other known weapons route electrical power from the electrical power source to the remote electrical accessories using internal electrical wires and/or electrical connectors. But, weapons are often disassembled, such as for cleaning and/or other maintenance. Such internal electrical wiring and connectors may make it difficult to disassemble the weapon, for example without damaging the electrical wires and/or connectors. Moreover, such internal electrical wires and/or electrical connectors may require relatively expensive and/or complex redesign of one or more components of the weapon to enable the internal electrical wires and/or connectors to reliably route electrical power from the electrical power source to the remote electrical accessories.

BRIEF DESCRIPTION OF THE INVENTION

In one embodiment, a powered rail system is provided for a weapon that includes a barrel. The powered rail system includes a base having a longitudinal opening. The base is configured to be mounted to the weapon such that the barrel is received within the longitudinal opening and the base extends around at least a segment of a length of the barrel. A rail extends from the base. An electrical component is mounted to the rail. An electrical power source is held by the base. The electrical power source is electrically connected to the electrical component for supplying the electrical component with electrical power.

In another embodiment, a weapon includes a barrel extending a length. The barrel is configured to receive and guide a projectile. The weapon includes a butt stock and a powered rail system. The powered rail system includes a base having a longitudinal opening. The barrel is received within the longitudinal opening such that the base extends around at least a segment of the length of the barrel. A rail extends from the base. An electrical component mounted to the rail. The powered rail system includes an electrical power source that is electrically connected to the electrical component for supplying the electrical component with electrical power. The electrical power source is positioned remote from the butt stock along a length of the weapon.

In another embodiment, a weapon includes a barrel extending a length. The barrel is configured to receive and guide a projectile. The weapon includes a chamber wherein the projectile is inserted prior to being fired, a butt stock, and a powered rail system. The powered rail system includes a base having a longitudinal opening. The barrel is received within the longitudinal opening such that the base extends around at least a segment of the length of the barrel. A rail extends from the base. An electrical component is mounted to the rail. The powered rail system includes an electrical power source electrically connected to the electrical component for supplying the electrical component with electrical power. The electrical power source is positioned along a length of the weapon such that the chamber extends between the electrical power source and the butt stock along the length of the weapon.

DETAILED DESCRIPTION OF THE INVENTION

Figure 1:
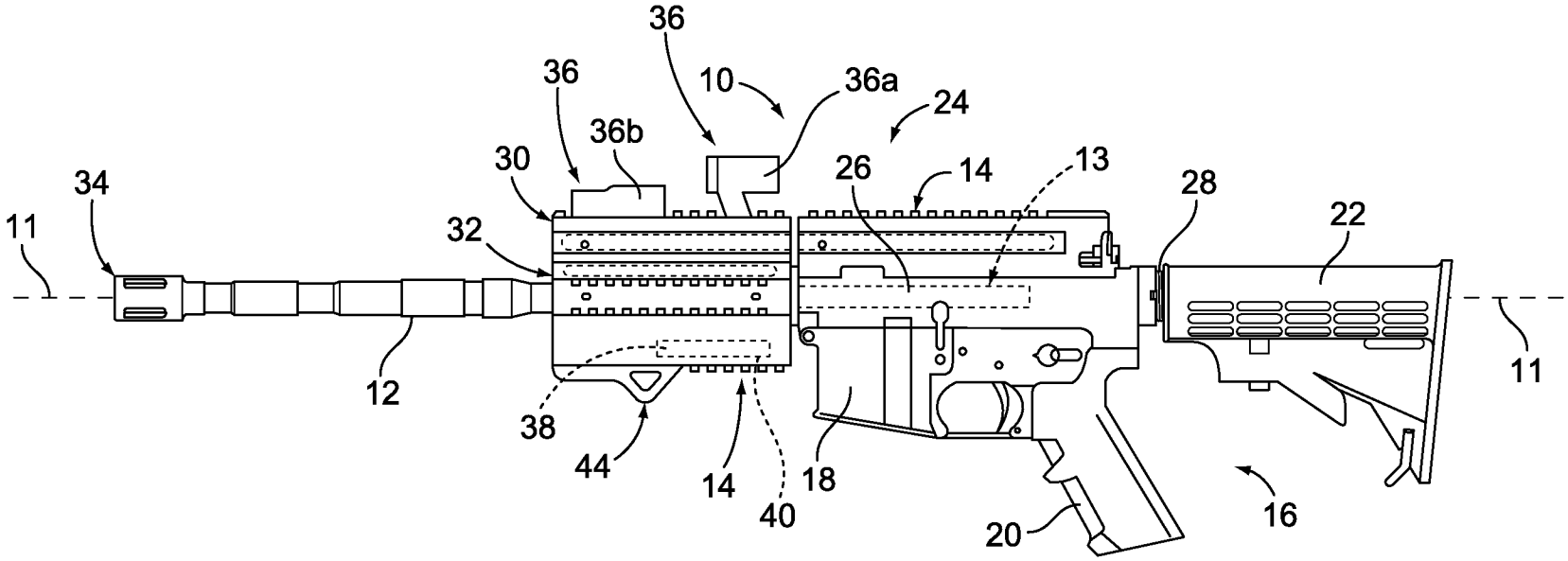
FIG. 1 is a side elevational view of an exemplary embodiment of a weapon.

FIG. 1 is a side elevational view of an exemplary embodiment of a weapon 10. In the exemplary embodiment, the weapon 10 is an AR-15 (or M-16) style weapon, however, the weapon 10 is not limited to AR-15 style weapons. For example, the weapon 10 is not limited to firearms that can be carried by a person. Rather, the weapon 10 may be any type of weapon. Other examples of the weapon 10 include, but are not limited to, artillery pieces, cannon, relatively large machine guns or other guns that cannot be carried by a person, and/or the like.

In the exemplary embodiment, the weapon 10 is of a type that includes a barrel 12 and a powered rail system 14. The weapon 10 extends a length along a central longitudinal axis 11. The weapon 10 includes a chamber 13 wherein a projectile is inserted prior to being fired. In the exemplary embodiment, the chamber 13 defines a segment of the barrel 12. But, the chamber 13 may be separate from the barrel 12 in alternative embodiments, for example similar to a revolver wherein the chamber is a portion of a firing cylinder. The weapon 10 may include a lower part 16 that includes a lower receiver 18, a hand grip 20, and a butt stock 22. The hand grip 20 and butt stock 22 each extend from the lower receiver 18 of the lower part 16. The lower part 16 may include other components of the weapon 10. The lower part 16 may sometimes be referred to as a "base". The powered rail system 14 may sometimes be referred to as a "forward rail system" or a "hand guard".

The weapon 10 may include an upper part 24 that is coupled to the lower part 16. The upper part 24 includes the barrel 12, an upper receiver 26, and the powered rail system 14. The upper part 24 may include other components of the weapon 10. The barrel 12 is provided at one end of the weapon 10 and the butt stock 22 is provided at the opposite end of the weapon 10. The upper receiver 26 of the upper part 24 and the lower receiver 18 of the lower part 16 may be removably coupled to one another. In the exemplary embodiment, the lower receiver 18 includes a buffer tube 28 extending rearward therefrom. The butt stock 22 is coupled to, and extends from, the buffer tube 28 of the lower receiver 18. The hand grip 20 extends from the lower receiver 18. Optionally, the upper receiver 26 is movable relative to the lower receiver 18 between a closed position (shown in FIG. 1) and an open position (not shown). In the open position, internal components of the weapon 10 may be accessed, such as, but not limited to, for removing a cartridge, casing, and/or projectile jammed in the weapon 10, and/or for cleaning the barrel 12.

The powered rail system 14 extends from the upper receiver 26. Specifically, the powered rail system 14 extends a length outwardly from the upper receiver 26 to an end 30 of the powered rail system 14. The powered rail system 14 includes a longitudinal opening 32 that extends through the length of the powered rail system 14. The barrel 12 is held by the upper receiver 26 such that the barrel 12 extends a length outwardly from the upper receiver 26 to an end 34 of the barrel 12. The barrel 12 extends from the upper receiver 26, through the opening 32 of the rail system 14, and outwardly from the end 30 of the powered rail system 14 to the end 34.

One or more electrical components 36 are mounted to the powered rail system 14. For example, the weapon 10 may include, but is not limited to including, a laser, a light (e.g., a flashlight), a sight, a range finder, night vision scope, a telescopic scope, a camera (e.g., a video camera, a night vision camera, and/or a still camera), a microphone, a control button, a control switch, a processor, a memory, a speaker, a circuit board, and/or the like that is mounted to the powered rail system 14. Although two electrical components 36 are shown in FIG. 1, the weapon 10 may include any number of electrical components 36 mounted to the powered rail system 14. Moreover, each electrical component 36 mounted to the powered rail system may be any type of electrical component, whether or not such a type of electrical component is described and/or illustrated herein. In the exemplary embodiment, the weapon 10 includes an electrical component 36*a* that is a telescopic sight and an electrical component 36*b* that is a range finder.

The electrical components 36 require a supply of electrical power to operate. The weapon 10 includes an electrical power source 38 that is electrically connected to the electrical components 36 for supplying the electrical components 36 with electrical power. As will be described in more detail below, the electrical power source 38 is incorporated into the powered rail system 14. For example, the electrical power source 38 may be held within an internal compartment 40 of a base 42 of the powered rail system 14.

One or more non-electrical components 44 may be mounted to the powered rail system 14. The non-electrical components 44 do not require a supply of electrical power to operate. Non-electrical components 44 that may be mounted to the powered rail system 14 include, but are not limited to, a sight, a telescopic scope, a camera, a hand grip, a strap, a handle, a sling, and/or the like. The weapon 10 may include any number of non-electrical components 44 mounted to the powered rail system 14. Each non-electrical component 44 mounted to the powered rail system may be any type of non-electrical component, whether or not such a type of non-electrical component is described and/or illustrated herein. In the exemplary embodiment, the weapon 10 includes a non-electrical component 44 that is a hand grip.

Figure 2:
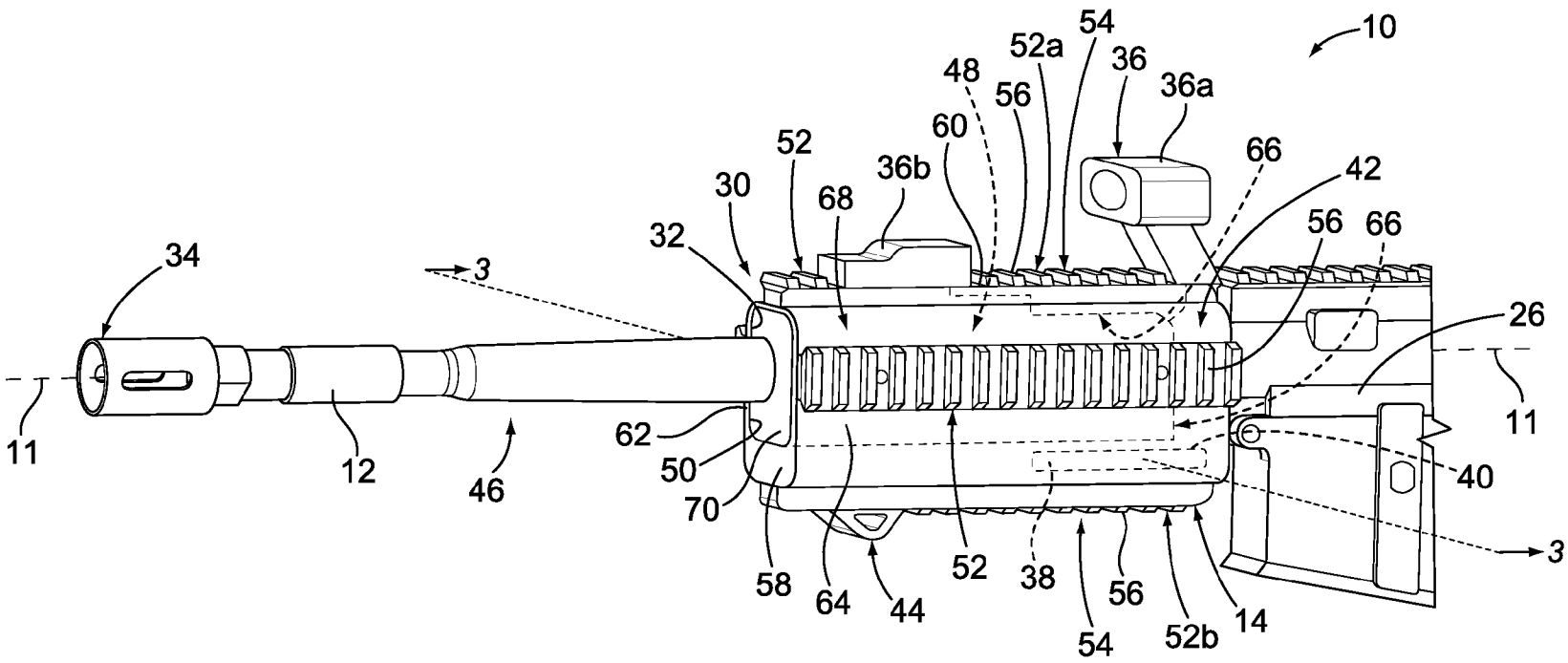
FIG. 2 is a perspective view of a portion of the weapon shown in FIG. 1.

FIG. 2 is a perspective view of a portion of the weapon 10. As described above, the length of the barrel 12 extends from the upper receiver 26, through the opening 32 of the powered rail system 14, and outwardly from the end 30 of the powered rail system 14 to the end 34 of the barrel 12. The length of the barrel 12 includes an exposed segment 46 and a covered segment 48. The exposed segment 46 extends outwardly from the end 30 of the powered rail system 14 and includes the end 34 of the barrel 12. At least a portion of the length of the exposed segment 46 is exposed to ambient air. Other components (not shown; such as, but not limited to, a sight and/or the like) of the weapon 10 may be mounted to the exposed segment 46 in a manner that covers at least a portion of the length of the exposed segment 46. Any amount of the length of the exposed segment 46 may be exposed to ambient air.

The covered segment 48 of the barrel 12 extends between the exposed segment 46 and the upper receiver 26. The powered rail system 14 includes the base 42. The base 42 includes the longitudinal opening 32 of the powered rail system 14. The base 42 is mounted to the weapon 10 such that the covered segment 48 of the barrel 12 extends within the longitudinal opening 32 and is at least partially surrounded by the base 42 of the powered rail system 14. In the exemplary embodiment, the base 42 of the powered rail system 14 surrounds an approximate entirety of the exterior circumference of the covered segment 48 along an approximate entirety of the length of the covered segment 48. But, the base 42 of the powered rail system 14 may alternatively surround only a portion of the exterior circumference of the covered segment 48 along an approximate entirety or only a portion of the length of the covered segment 48. For example, the base 42 may not form a continuous ring around the exterior circumference of the covered segment 48 and/or the base 42 may include one or more slots (not shown) that exposes a portion of the exterior circumference of the covered segment 48. Optionally, and as shown in the exemplary embodiment, an interior surface 50 of the base 42 that defines the longitudinal opening 32 is spaced radially apart (relative to the central longitudinal axis 11) from the exterior circumference of the covered segment 48 of the barrel 12.

The powered rail system 14 includes one or more rails 52 that extend from the base 42. The powered rail system 14 may include any number of the rails 52. In the exemplary embodiment, the powered rail system 14 includes four rails 52. The electrical components 36 are mounted to the powered rail system 14. In the exemplary embodiment, the electrical components 36*a* and 36*b* are mounted to an upper rail 52*a* of the rails 52 and the non-electrical component 44 is mounted to a lower rail 52*b* of the rails 52. But, the electrical components 36*a* and 36*b* and the non-electrical component 44 may each be mounted to any of the rails 52. In some embodiments, the rails 52 are integrally formed with the base 42 from the same materials as the base 42. In other embodiments, the rails 52 are discrete components of the powered rail system 14 that are mounted to the base 42.

One or more of the rails 52 may include a textured surface 54 or other structure to, for example, facilitate mounting one or more components to the rails 52 and/or provide a non-slippery gripping surface. In the exemplary embodiment, the textured surface 54 of the rails 52 is provided by a plurality of teeth 56 that extend outwardly on the rails 52. Other textures and structures may be provided in addition or alternative to the teeth 56. The teeth 56 are sometimes referred to as "recoil grooves". The powered rail system 14 may function as a hand guard. Specifically, the powered rail system 14 may provide a location on the weapon 10 for a user to grasp and/or support the weapon 10 with the user's hand and/or arm.

Figure 3:
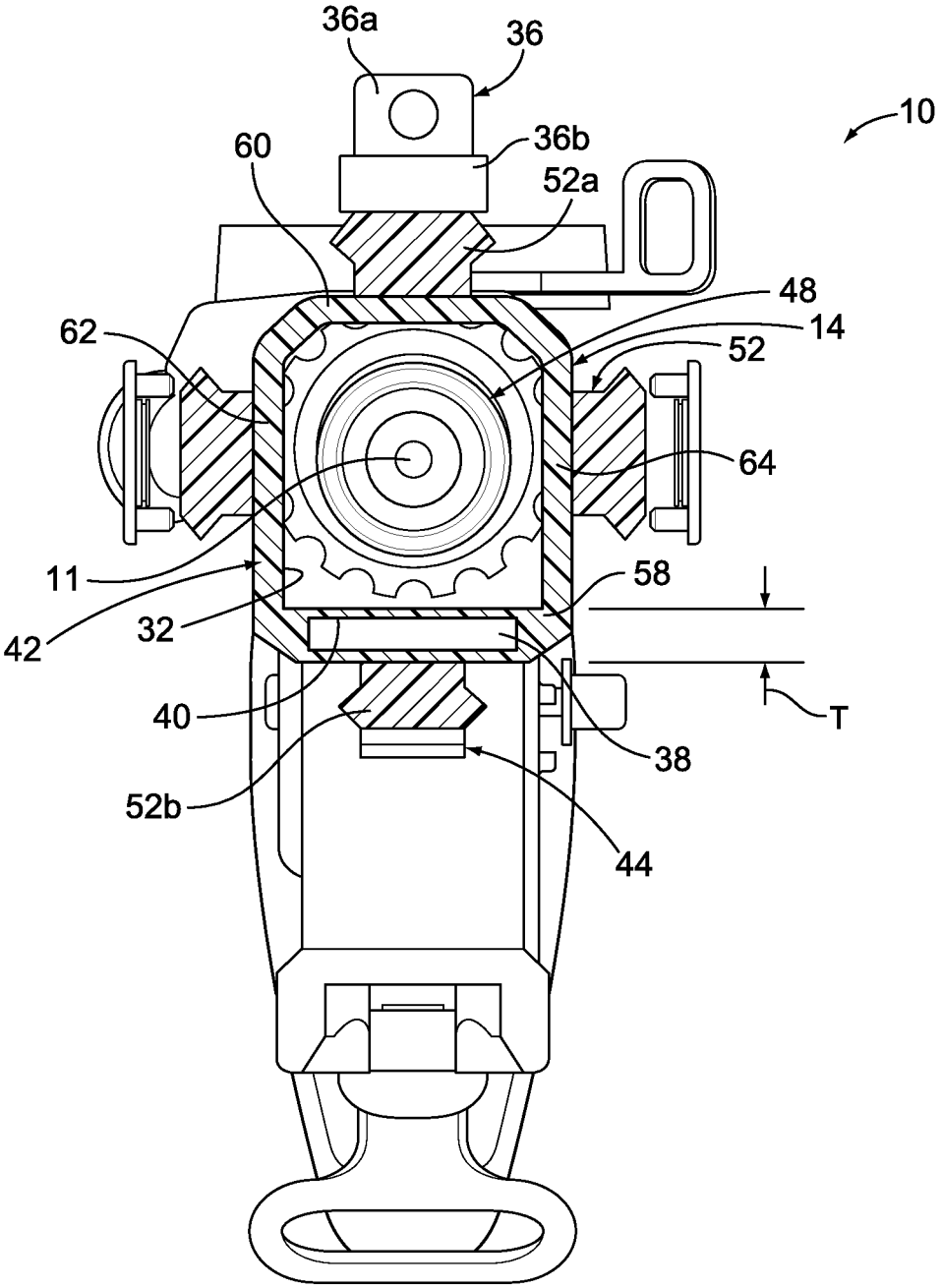
FIG. 3 is a cross-sectional view of the weapon shown in FIGS. 1 and 2 taken along line 3-3 of FIG. 2.

FIG. 3 is a cross-sectional view of the weapon 10 taken along line 3-3 of FIG. 2. Referring now to FIGS. 2 and 3, as briefly described above, the electrical power source 38 is incorporated into the powered rail system 14 of the weapon 10. In the exemplary embodiment of the weapon 10, the electrical power source 38 is held within the internal compartment 40 of the base 42 of the powered rail system 14.

In the exemplary embodiment, the base 42 of the powered rail system 14 includes the general shape of a parallelepiped, wherein the base 42 includes a lower wall 58, an upper wall 60, and side walls 62 and 64. The upper rail 52*a* extends on the upper wall 60, while the lower rail 52*b* extends on the lower wall 58. Although shown as having a general rectangular shape wherein the base 42 is an equiangular quadrilateral, each of the walls 58, 60, 62, and 64 may have any angle relative to each of the adjacent walls 58, 60, 62, and 64. Moreover, the base 42 is not limited to having the general shape of a parallelepiped. Rather, the base 42 may additionally or alternatively include any other shape, such as, but not limited to, a triangular shape, a cylindrical shape, an oval shape, and/or the like.

An exemplary embodiment of the incorporation of the electrical power source 38 into the powered rail system 14 of the weapon 10 will now be described. The internal compartment 40 extends within a thickness T (not labeled in FIG. 2) of the lower wall 58 of the base 42. The electrical power source 38 is held by the lower wall 58 of the base 42 of the powered rail system 14. Specifically, the electrical power source 38 is received within the internal compartment 40 of the base 42, which extends within the lower wall 58 of the base 42. In other words, the electrical power source 38 is incorporated into the lower wall 58 of the base 42. The internal compartment 40 thus provides a location within the lower wall 58 of the base 42 wherein the electrical power source 38 can be held for supplying electrical power to the electrical components 36 that are mounted to the rails 52 of the powered rail system 14.

Referring again to FIG. 1, the internal compartment 40 of the base 42 is positioned such that the chamber 13 of the weapon 10 extends between the internal compartment 40 and the butt stock 22 along the length of the weapon 10. The internal compartment 40 is remote from the butt stock 22 along the length of the weapon 10. For example, the internal compartment 40 is spaced apart from the butt stock 22 along the length of the weapon 10 by the lower receiver 18 and the upper receiver 26 of the weapon 10. The electrical power source 38 is received within the internal compartment 40. The electrical power source 38 is thus positioned along the length of the weapon 10 such that the chamber 13 extends between the electrical power source 38 and the butt stock 22 along the length of the weapon 10 and such that the electrical power source 38 is remote from the butt stock 22 along the length of the weapon 10.

Referring again to FIG. 2, the electrical power source 38 is electrically connected to each of the electrical components 36 for supplying the electrical components 36 with electrical power. Specifically, the electrical power source 38 is electrically connected to the electrical components 36*a* and 36*b* through an associated wiring system 66. The wiring system 66 forms one or more electrical supply pathways between the electrical power source 38 and the electrical components 36*a* and 36*b*. The wiring system 66 includes components, such as, but not limited to, one or more electrical wires (not shown), one or more electrical cables (not shown), one or more electrical connectors (not shown), one or more other wiring and/or electrical connection components, and/or the like, to form the electrical pathways between the electrical power source 38 and the electrical components 36*a* and 36*b*. The wiring system 66 may electrically connect the electrical power source 38 to the electrical components 36*a* and 36*b* in series or in parallel. Each of the various components of the wiring system 66 may extend through and/or within a thickness of the base 42 (e.g., through and/or within a thickness of the walls 58, 60, 62, and/or 64), along an exterior surface 68 of the powered rail system 14, and/or along the interior surface 50 of the base 42 that defines the longitudinal opening 32. In other words, the electrical pathways provided by the wiring system 66 may extend through and/or within the thickness of the base 42, external to the base 42, and/or within the longitudinal opening 32 of the base 42. In some embodiments, various components of the wiring system 66 may be positioned to extend through and/or within the thickness of the base 42 and/or external to the base 42 to facilitate shielding such components from heat emitted from the covered segment 48 of the barrel 12. Moreover, in some embodiments, various components of the wiring system 66 may be provided with a thermal insulator (not shown) to facilitate shielding such components from heat emitted from the covered segment 48 of the barrel 12

As can be seen in FIGS. 2 and 3, the location of the internal compartment 40 within the lower wall 58 of the base 42 spaces the internal compartment 40 apart from the barrel 12 when the powered rail system 14 is mounted to the weapon 10. Specifically, the internal compartment 40 is spaced radially apart (relative to the central longitudinal axis 11) from the exterior circumference of the covered segment 48 of the barrel 12. Accordingly, the electrical power source 38 is spaced radially apart (relative to the central longitudinal axis 11) from the exterior circumference of the covered segment 48 of the barrel 12 when the electrical power source 38 is received within the internal compartment 40. The radial spacing of the electrical power source 38 relative to the barrel 12 may facilitate shielding the electrical power source 38 from heat emitted from the covered segment 48 of the barrel 12. For example, in some embodiments, an air gap extends between the exterior circumference of the covered segment 48 and the interior surface 50 of the base 42. The air gap provides thermal insulation between the covered segment 48 of the barrel 12 and the internal compartment 40 (and thus the electrical powers source 38). Moreover, the portion of the lower wall 58 that extends between the covered segment 48 of the barrel 12 and the internal compartment 40 may provide thermal insulation between the covered segment 48 of the barrel 12 and the internal compartment 40 (and thus the electrical powers source 38). In some embodiments, the material(s) of the base 42 are selected to provide a predetermined amount of thermal insulation between the covered segment 48 of the barrel 12 and the internal compartment 40.

Referring again solely to FIG. 2, optionally, a thermal insulation member 70 that extends between the powered rail system 14 and the barrel 12 along at least a portion of the length of the base 42. Specifically, the thermal insulation member 70 extends within the longitudinal opening 32 of the base 42 radially between the interior surface 50 of the base 42 and the exterior circumference of the covered segment 48 of the barrel 12. The thermal insulation member 70 provides thermal insulation between the internal compartment 40 (and thus the electrical power source 38) and the covered segment 48 of the barrel 12. The thermal insulation member 70 may be configured to provide any amount of thermal insulation between the barrel 12 and the electrical power source 38. The thermal insulation member 70 may be fabricated from any materials that enable the thermal insulation member 70 to provide thermal insulation between the electrical power source 38 and the barrel 12, such as, but not limited to, mineral wool, glass wool, a composite material, an elastomeric foam, a rigid foam, plyethylene, aerogel, a spray foam, wood, extruded polystyrene foam, and/or the like.

The electrical power source 38 may be any type of electrical power source, such as, but not limited to, a battery, a rechargeable battery, a double A battery, an AAAA battery, a 9-volt battery, a 4.5 volt battery, an A23 battery, a triple A battery, a C battery, a D battery, a fuel cell, a lithium polymer battery, a lithium ion battery, an electrical generator, and/or the like. Although shown as being electrically connected to two electrical components 36*a* and 36*b*, the electrical power source 38 may be electrically connected to any number of electrical components. In other words, the electrical power source 38 may supply any number of electrical components 36 with electrical power. Although shown as having the general shape of a parallelepiped for receiving an electrical power source having the general shape of a parallelepiped, the internal compartment 40 may additionally or alternatively include any other shape for receiving one or more electrical power sources that include any shape, whether or not the shape of the internal compartment 40 is complementary with the shape of the electrical power source(s).

The internal compartment 40 and the electrical power source 38 are not limited to the location within the lower wall 58 of the base 42 shown herein. Rather, in addition or alternative to the location shown herein, the internal compartment 40 and the electrical power source 38 may have any other location within the lower wall 58. For example, the internal compartment 40 and the electrical power source 38 may have a different location along the lower wall 58 that overlaps or does not overlap the location shown herein. Moreover, the internal compartment 40 and the electrical power source 38 are not limited to being located within the lower wall 58 of the base 42. Rather, the internal compartment 40 and the electrical power source 38 may have any other locations along the powered rail system 14. For example, in addition or alternative to being located within the lower wall 58, the internal compartment 40 and the electrical power source 38 may be located within the upper wall 60, the side wall 62, and/or the side wall 64. Moreover, and for example, in addition or alternative to being located within the walls 58, 60, 62, and/or 64, the internal compartment 40 and the electrical power source 38 may be located within one or more of the rails 52. Other contemplated locations of the internal compartment 40 and the electrical power source 38 in addition or alternative to the base 42 include one or more components (e.g., a hand grip, a dedicated power source housing, and/or the like) that are held by the base 42. For example, the internal compartment 40 and the electrical power source 38 may be located within one or more components that are mounted to one or more of the rails 52 and/or within one or more components that are mounted to a portion of the base 42.

The internal compartment 40 may have any size for receiving any sized electrical power source(s) 38. Although shown as holding only a single electrical power source 38, any number of electrical power sources 38 may be received within the internal compartment 40. Moreover, although only one is shown, the powered rail system 14 may include any number of internal compartments 40 for any number of electrical power sources 38, wherein each internal compartment 40 may hold any number of electrical power sources 38 and wherein each internal compartment 40 may have any location along and/or within the various components (e.g., the base 42, the components 36, the components 44, the rails 52, and/or the like) of the powered rail system 14. When the powered rail system 14 includes a plurality of electrical power sources 38, each electrical power source 38 may be electrically connected to any number of the electrical components 36.

Figure 4:
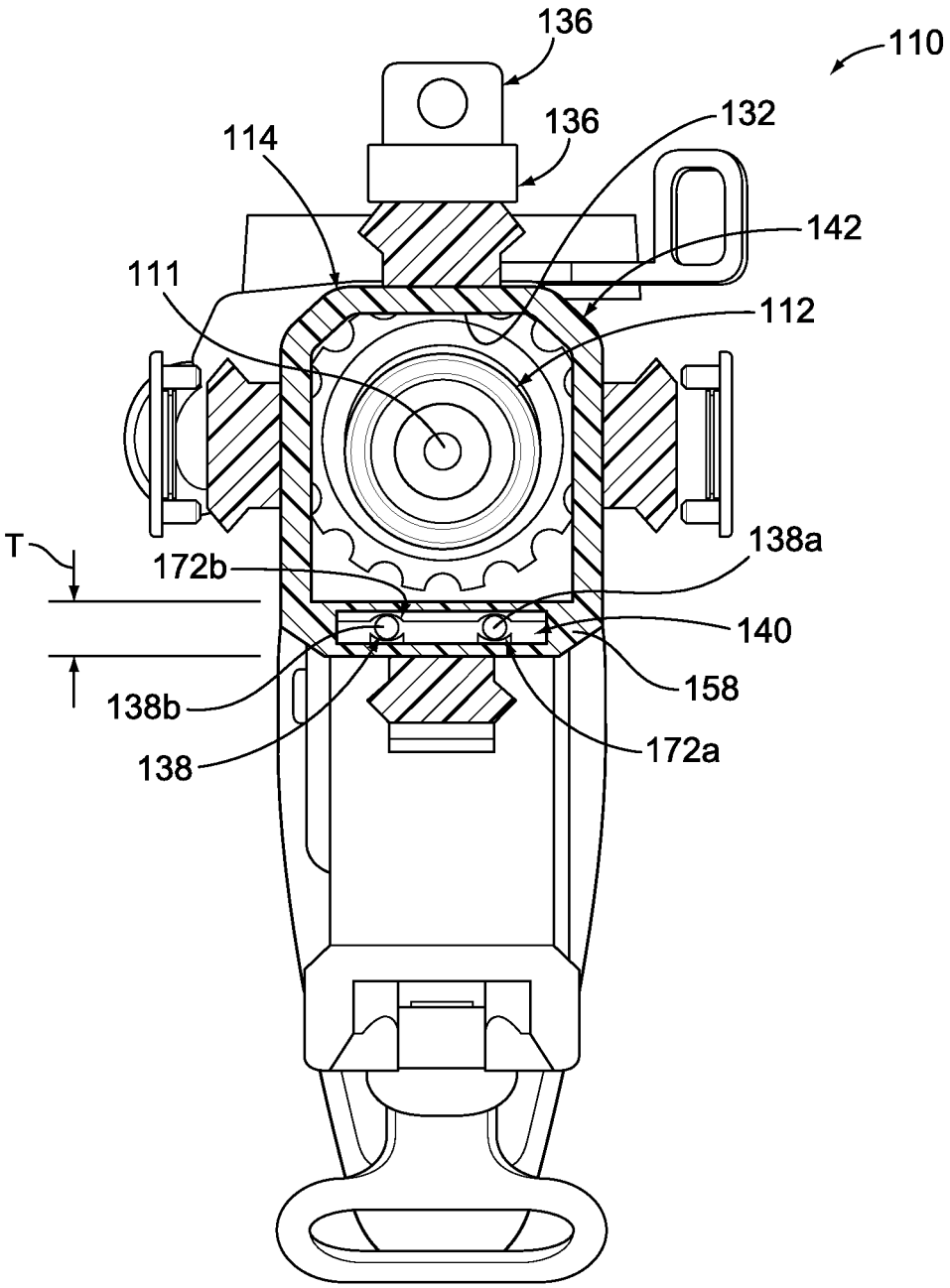
FIG. 4 is a cross-sectional view of another exemplary embodiment of a weapon.

FIG. 4 is a cross-sectional view of another exemplary embodiment of a weapon 110 illustrating another exemplary embodiment of an internal compartment 140 that holds an electrical power source 138. The weapon 110 extends a length along a central longitudinal axis 111. The weapon 110 includes a barrel 112 and a powered rail system 114. The powered rail system 114 includes a base 142 having a longitudinal opening 132 that extends therethrough. The barrel 112 extends through the longitudinal opening 132 such that the base 142 extends around the barrel 112. One or more electrical components 136 are mounted to the powered rail system 114. The weapon 110 includes the electrical power source 138, which is electrically connected to the electrical components 136 for supplying the electrical components 136 with electrical power.

The electrical power source 138 is incorporated into the powered rail system 114 and includes two electrical power sources 138*a* and 138*b*. The electrical power sources 138*a* and 138*b* are each cylindrical batteries (e.g., double A batteries, triple A batteries, AAAA batteries, C batteries, D batteries, an E battery, A23 batteries, and/or the like). The base 142 of the powered rail system 114 includes an internal compartment 140 that extends within a thickness T of a lower wall 158 of the base 142. The electrical power sources 138*a* and 138*b* are held by the lower wall 158 of the base 142. Specifically, the electrical power sources 138*a* and 138*b* are each received within the internal compartment 140 of the base 142. Accordingly, the electrical power sources 138 are incorporated into the lower wall 158 of the base 142.

The internal compartment 140 of the base 142 includes two cylindrical cradles 172*a* and 172*b* that extend lengths along the central longitudinal axis 111. The cradles 172*a* and 172*b* are arranged side-by-side on opposite sides of the central longitudinal axis 111. The cradles 172*a* and 172*b* are configured to hold the electrical power sources 138*a* and 138*b*, respectively, such that lengths of the cylinders of the electrical power sources 138*a* and 138*b* extend along the central longitudinal axis 111. The electrical power sources 138*a* and 138*b* are electrically connected to the electrical components 136 through an associated wiring system (not shown) that forms one or more electrical supply pathways between the electrical power sources 138*a* and 138*b* and the electrical components 136.

Although two are shown, the internal compartment 140 may include any number of cradles. Although each cradle 172*a* and 172*b* is described as receiving only a single electrical power source 138*a* and 138*b*, respectively, therein, each cradle 172*a* and 172*b* may hold any number of electrical power sources 138. For example, the cradle 172*a* and/or the cradle 172*b* may hold a series of cylindrical electrical power sources 138 arranged in a line along the length of the cradle 172*a* and/or 172*b*. Moreover, the cradles 172*a* and 172*b* are not limited to the arrangement shown and described herein, but rather, the cradles 172*a* and 172*b* may have any other arrangement. For example, the cradles 172*a* and 172*b* may be arranged such that the lengths of the cradles 172*a* and 172*b* extend transversely across the central longitudinal axis 111 instead of along the central longitudinal axis 111.

Figure 5:
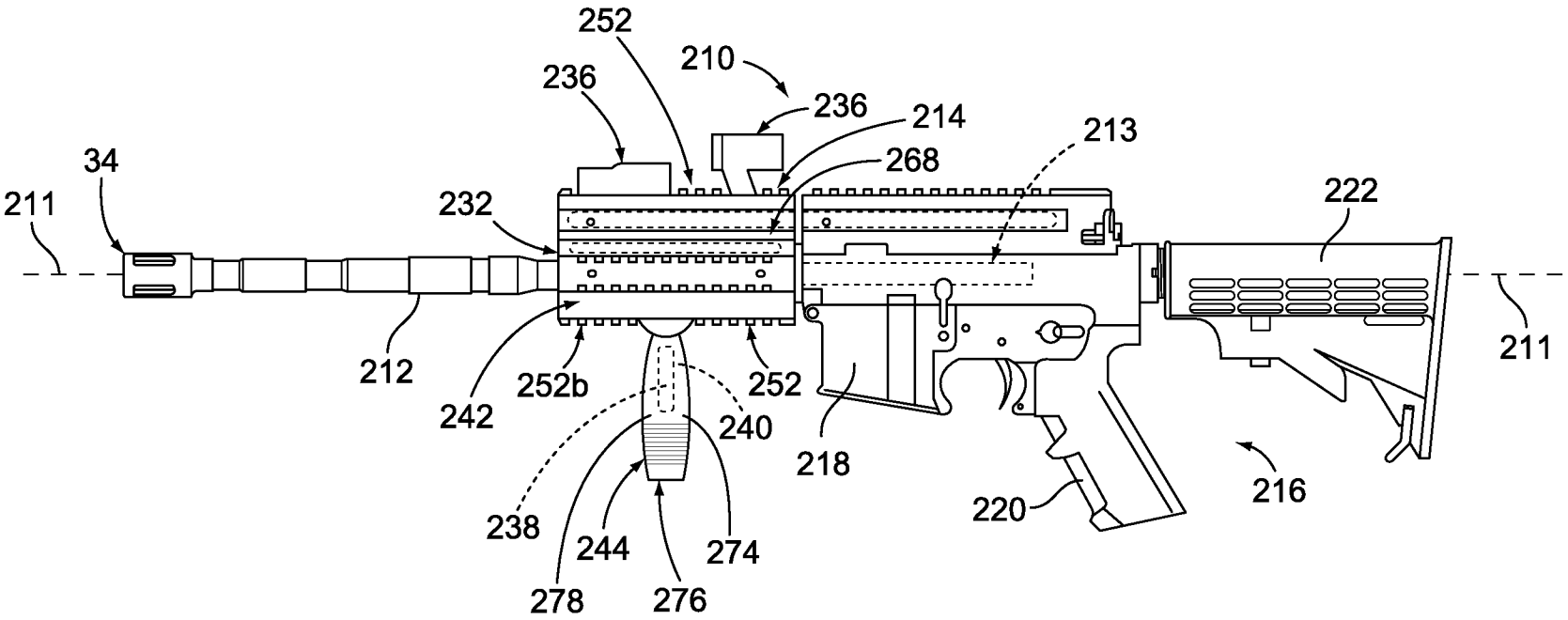
FIG. 5 is a side elevational view of another exemplary embodiment of a weapon.

FIG. 5 is a side elevational view of another exemplary embodiment of a weapon 210 illustrating another exemplary embodiment of an internal compartment 240 that holds an electrical power source 238. The weapon 210 extends a length along a central longitudinal axis 211 and includes a barrel 212 and a powered rail system 214. The weapon 210 includes a chamber 213 wherein a projectile is inserted prior to being fired. The weapon 210 includes a lower receiver 218, a hand grip 220, and a butt stock 222. The powered rail system 214 includes a base 242 having a longitudinal opening 232 that extends therethrough. The barrel 212 extends through the longitudinal opening 232 such that the base 242 extends around the barrel 212. One or more electrical components 236 are mounted to the powered rail system 214.

The powered rail system 214 includes the base 242 and one or more rails 252 extending from the base 242. A hand grip 244 is held by the base 242. Specifically, the hand grip 244 is mounted to a lower rail 252*b* of the rails 252. The hand grip 244 includes an elongate handle 274. The handle 274 extends a length outwardly from the rail 252*b* to an end 276 of the handle 274. The length of the handle 274 extends outwardly from the rail 252*b* in an approximately perpendicular direction relative to the length of the barrel 212. In other words, the length of the handle 274 extends approximately perpendicular relative to the central longitudinal axis 211. The hand grip 244 is not limited to being mounted to the rail 252*b*, but rather may be mounted to any of the other rails 252 in addition or alternative to the rail 252*b*. Moreover, in addition or alternatively to being mounted to one or more rails 252, the hand grip 244 may be mounted to a portion of the base 242.

The electrical power source 238 is incorporated into the powered rail system 214, and more particularly into the hand grip 244 of the powered rail system 214. Specifically, the electrical power source 238 is held by the hand grip 244. In the exemplary embodiment of the weapon 210, the hand grip 244 includes an internal compartment 240 that receives the electrical power source 238 therein. Alternatively, the electrical power source 238 is held by the hand grip 244 by being mounted to an external surface 278 of the hand grip 244, for example within a dedicated power source housing (not shown).

As can be seen in FIG. 5, the hand grip 244, and thus the internal compartment 240, is positioned such that the chamber 213 of the weapon 210 extends between the internal compartment 240 and the butt stock 222 along the length of the weapon 210. The internal compartment 240 is remote from the butt stock 222 along the length of the weapon 210. The electrical power source 238 is received within the internal compartment 240. The electrical power source 238 is thus positioned along the length of the weapon 210 such that the chamber 213 extends between the electrical power source 238 and the butt stock 222 along the length of the weapon 210 and such that the electrical power source 238 is remote from the butt stock 222 along the length of the weapon 210.

The electrical power source 238 is electrically connected to each of the electrical components 236 through an associated wiring system (not shown) that forms one or more electrical supply pathways between the electrical power source 238 and the electrical components 236. Each of the various components of the wiring system may extend through and/or within a thickness of the base 242, through and/or within a thickness of the hand grip 244, along the exterior surface 278 of the hand grip 244, along an exterior surface 268 of the powered rail system 214, and/or along an interior surface 250 of the base 242 that defines the longitudinal opening 232.

As can be seen in FIG. 5, the location of the internal compartment 240 within the hand grip 244 spaces the internal compartment 240 apart from the barrel 212 when the powered rail system 214 is mounted to the weapon 210. Accordingly, the electrical power source 238 is spaced apart from the barrel 212 when the electrical power source 238 is received within the internal compartment 240. The spacing of the electrical power source 238 relative to the barrel 212 may facilitate shielding the electrical power source 238 from heat emitted from the barrel 212.

Figure 6:
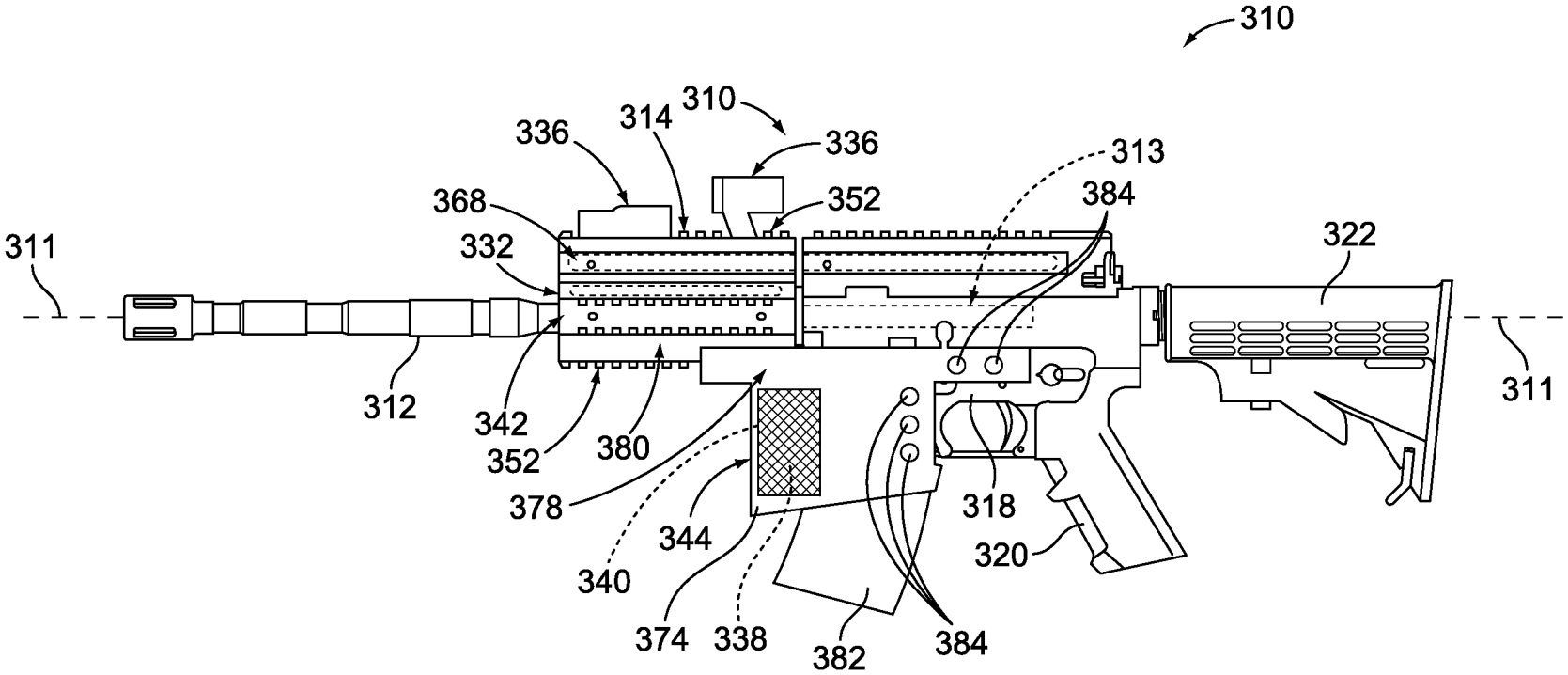
FIG. 6 is a side elevational view of a portion of another exemplary embodiment of a weapon.

FIG. 6 is a side cross-sectional view of another exemplary embodiment of a weapon 310 illustrating another exemplary embodiment of an internal compartment 340 that holds an electrical power source 338. The weapon 310 extends a length along a central longitudinal axis 311 and includes a barrel 312 and a powered rail system 314. The weapon 310 includes a chamber 313 wherein a projectile is inserted prior to being fired. The weapon 310 includes a lower receiver 318, a hand grip 320, and a butt stock 322. The powered rail system 314 includes a base 342 having a longitudinal opening 332 that extends therethrough. The barrel 312 extends through the longitudinal opening 332 such that the base 342 extends around the barrel 312. One or more electrical components 336 are mounted to the powered rail system 314.

The powered rail system 314 includes the base 342 and one or more rails 352 extending from the base 342. A hand grip 344 is held by the base 342. Specifically, the hand grip 344 is mounted to a lower portion 380 of the base 342. The hand grip 344 includes a handle 374. The handle 374 extends from the base 342 to the lower receiver 318, whereat the handle 374 wraps around a cartridge 382 of the weapon 310. The hand grip 344 is not limited to being mounted to the base 342, but rather may be mounted to any of the rails 352 in addition or alternative to the base 342. The hand grip 344 includes one or more control switches and/or buttons 384 that are electrically connected to one or more corresponding electrical components 336 for controlling operation of the corresponding electrical component(s) 336.

The electrical power source 338 is incorporated into the powered rail system 314, and more particularly into the hand grip 344 of the powered rail system 314. Specifically, the electrical power source 338 is held by the hand grip 344. In the exemplary embodiment of the weapon 310, the hand grip 344 includes an internal compartment 340 that receives the electrical power source 338 therein. Alternatively, the electrical power source 338 is held by the hand grip 344 by being mounted to an external surface 378 of the hand grip 344, for example within a dedicated power source housing (not shown).

As can be seen in FIG. 6, the hand grip 344, and thus the internal compartment 340, is positioned such that the chamber 313 of the weapon 310 extends between the internal compartment 340 and the butt stock 322 along the length of the weapon 310. The internal compartment 340 is remote from the butt stock 322 along the length of the weapon 310. The electrical power source 338 is received within the internal compartment 340. The electrical power source 338 is thus positioned along the length of the weapon 310 such that the chamber 313 extends between the electrical power source 338 and the butt stock 322 along the length of the weapon 310 and such that the electrical power source 338 is remote from the butt stock 322 along the length of the weapon 310.

The electrical power source 338 is electrically connected to each of the electrical components 336 through an associated wiring system (not shown) that forms one or more electrical supply pathways between the electrical power source 338 and the electrical components 336. Each of the various components of the wiring system may extend through and/or within a thickness of the base 342, through and/or within a thickness of the hand grip 344, along the exterior surface 378 of the hand grip 344, along an exterior surface 368 of the powered rail system 314, and/or along an interior surface 350 of the base 342 that defines the longitudinal opening 332.

As can be seen in FIG. 6, the location of the internal compartment 340 within the hand grip 344 spaces the internal compartment 340 apart from the barrel 312 when the powered rail system 314 is mounted to the weapon 310. Accordingly, the electrical power source 338 is spaced apart from the barrel 312 when the electrical power source 338 is received within the internal compartment 340. The spacing of the electrical power source 338 relative to the barrel 312 may facilitate shielding the electrical power source 338 from heat emitted from the barrel 312.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A powered rail system for a weapon that includes a barrel, the powered rail system comprising:

a base having an upper wall, a lower wall, and opposing first and second side walls, the base defining a longitudinal opening therethrough, the longitudinal opening extending vertically between the upper wall and the lower wall and extending laterally between the first side wall and the second side wall, the base being configured to be mounted to the weapon such that the barrel is received within the longitudinal opening and the base extends around at least a segment of a length of the barrel, at least one of the upper wall, the lower wall, the first side wall, or the second side wall being a compartment wall that defines an internal compartment within a thickness of the compartment wall, the internal compartment is being separated from the longitudinal opening of the base by an inner portion of the compartment wall, and the internal compartment is being separated from an exterior surface of the base by an outer portion of the compartment wall;

a rail extending from the base;

an electrical component mounted to the rail; and an electrical power source held within the internal compartment of the compartment wall of the base, the electrical power source being electrically connected to the electrical component through a wiring system for supplying the electrical component with electrical power, the wiring system extending within the thickness of the compartment wall to provide an electrical pathway between the electrical power source and the electrical component.

2. The powered rail system of claim 1, wherein the electrical power source comprises at least one of a battery, a rechargeable battery, a double A battery, an AAAA battery, a 9-volt battery, a 4.5 volt battery, an A23 battery, a triple A battery, a C battery, a D battery, a fuel cell, a lithium polymer battery, a lithium ion battery, or an electrical generator.

3. The powered rail system of claim 1, wherein the electrical component comprises at least one of a laser, a light, a sight, a night vision scope, a telescopic scope, a camera, a rangefinder, a control button, a control switch, a microphone, a processor, a circuit board, a memory, or a speaker.

4. The powered rail system of claim 1, wherein the electrical power source is cylindrical and the base includes a cylindrical cradle mounted to the compartment wall within the internal compartment, the electrical power source being received within the cylindrical cradle to hold the electrical power source in a fixed orientation within the internal compartment.

5. The powered rail system of claim 1, wherein the rail extends from the outer portion of the compartment wall of the base.

6. The powered rail system of claim 1, wherein the compartment wall is the lower wall, the internal compartment being defined vertically between the inner portion of the compartment wall and the outer portion of the compartment wall, the internal compartment being defined laterally between first and second end portions of the compartment wall that extend between the inner and outer portions, the first end portion of the compartment wall coupled to the first side wall of the base, the second end portion of the compartment wall coupled to the second side wall of the base, wherein the electrical power source held within the internal compartment is enclosed by the inner portion, the outer portion, and the first and second end portions or the lower wall.

7. The powered rail system of claim 1, wherein the lower wall is the only compartment wall of the base, the thickness of the lower wall being greater than a thickness of each of the upper wall, the first side wall, and the second side wall.

8. The powered rail system of claim 1, wherein the wiring system includes at least one of wires or cables that have a thermal insulator.

9. The powered rail system of claim 1, wherein the wiring system extends at least one of through or within a thickness of multiple walls of the upper wall, the lower wall, the first side wall, and the second side wall of the base.

10. The powered rail system of claim 1, further comprising a thermal insulation member extending within the longitudinal opening of the base, the thermal insulation member being configured to extend between the barrel and the upper wall, the lower wall, and the first and second side walls of the base when the powered rail system is mounted to the weapon.

11. A weapon comprising:

a barrel extending a length, the barrel being configured to receive and guide a projectile;

a butt stock; and a powered rail system comprising:

a base having an upper wall, a lower wall, and opposing first and second side walls, the base defining a longitudinal opening therethrough, the longitudinal opening extending vertically between the upper wall and the lower wall and extending laterally between the first side wall and the second side wall, the barrel being received within the longitudinal opening such that the base extends around at least a segment of the length of the barrel, the base comprising an internal compartment within a thickness of at least one of the upper wall, the lower wall, the first side wall, or the second side wall;

a rail extending from the base;

an electrical component mounted to the rail;

an electrical power source electrically connected to the electrical component for supplying the electrical component with electrical power, the electrical power source being positioned remote from the butt stock along a length of the weapon, the electrical power source being received within the internal compartment, the electrical power source being electrically connected to the electrical component via a wiring system that extends within the thickness of at least one of the upper wall, the lower wall the first side wall, or the second side wall of the base to provide an electrical pathway between the electrical power source and the electrical component; and a thermal insulation member extending within the longitudinal opening of the base radially between interior surfaces of the upper wall, the lower wall, and the first and second side walls of the base and an exterior circumference of the barrel along at least a portion of the length of the barrel.

12. The weapon of claim 11 , wherein the electrical power source comprises at least one of a battery, a rechargeable battery, a double A battery, an AAAA battery, a 9-volt battery, a 4.5 volt battery, an A23 battery, a triple A battery, a C battery, a D battery, a fuel cell, a lithium polymer battery, a lithium ion battery, or an electrical generator.

13. The weapon of claim 11, wherein the electrical component comprises at least one of a laser, a light, a sight, a night vision scope, a telescopic scope, a camera, a rangefinder, a control button, a control switch, a microphone, a processor, a circuit board, a memory, or a speaker.

14. The weapon of claim 11, further comprising a lower receiver, an upper receiver that is configured to be coupled to the lower receiver, and a hand grip extending from the lower receiver, the barrel extending from the upper receiver, the butt stock extending from the lower receiver.

15. The weapon of claim 11, wherein the thermal insulation member comprises at least one of mineral wool, glass wool, a composite material, polyethylene, aerogel, or wood.

16. The weapon of claim 11, wherein the thermal insulation member has a non-amorphous exterior shape.

17. The weapon of claim 11, wherein the at least one of the upper wall, the lower wall, the first side wall, or the second side wall that has the internal compartment includes an inner portion between the internal compartment and the longitudinal opening and an outer portion between the internal compartment and an exterior surface of the base.

18. A weapon comprising:

a barrel extending a length, the barrel being configured to receive and guide a projectile;

a chamber wherein the projectile is inserted prior to being fired;

a butt stock; and a powered rail system comprising:

a base having an upper wall, a lower wall, and opposing first and second side walls, and the base defining a longitudinal opening therethrough, the longitudinal opening extending vertically between the upper wall and the lower wall and extending laterally between the first side wall and the second side wall, the barrel being received within the longitudinal opening such that the base extends around at least a segment of the length of the barrel, at least one of the upper wall, the lower wall, the first side wall, or the second side wall being a compartment wall that has an internal compartment within a thickness of the compartment wall, the compartment wall having an inner portion between the internal compartment and the longitudinal opening, the compartment wall having an outer portion between the internal compartment and an exterior surface of the base;

a rail extending from the base;

an electrical component mounted to the rail; and an electrical power source electrically connected to the electrical component through a wiring system for supplying the electrical component with electrical power, wherein the electrical power source is held within the internal compartment of the compartment wall of the base such that the electrical power source is positioned along a length of the weapon with the chamber extending between the electrical power source and the butt stock along the length of the weapon, the wiring system extending within the thickness of the compartment wall to provide an electrical pathway between the electrical power source and the electrical component.

19. The weapon of claim 18, wherein the electrical power source is cylindrical and the base includes a cylindrical cradle mounted to the compartment wall within the internal compartment, the electrical power source being received within the cylindrical cradle to hold the electrical power source in a fixed orientation within the internal compartment.

* * * * *